United States Patent [19]

Reid et al.

[11] 4,178,136

[45] Dec. 11, 1979

[54] GUIDE SHOE MEMBERS FOR WOBBLE PLATE COMPRESSOR

[75] Inventors: Earl Reid, Dayton; Carl A. Copp, Jr., Vandalia, both of Ohio

[73] Assignee: General Motors Corporation, Detroit, Mich.

[21] Appl. No.: 911,818

[22] Filed: Jun. 2, 1978

[51] Int. Cl.[2] ..... F04B 1/14

[52] U.S. Cl. ..... 417/269

[58] Field of Search ..... 417/269; 74/60

[56] References Cited

U.S. PATENT DOCUMENTS

| | | | |
|---|---|---|---|
| 2,798,663 | 7/1957 | Chayne et al. | 417/269 |
| 2,825,499 | 3/1958 | Gibson et al. | 417/269 |
| 4,061,443 | 12/1977 | Black et al. | 417/269 |
| 4,073,603 | 2/1978 | Abenschein | 417/269 |

*Primary Examiner*—William L. Freeh

*Attorney, Agent, or Firm*—Edward P. Barthel

[57] ABSTRACT

A guide rod, with a ball on its free end, extends radially from a compressor wobble plate with the ball and rod being positioned for longitudinal and arcuate travel in a guide slot of the compressor housing as a result of the wobble plate movement. An improved pair of spaced guide shoe members are positioned in the slot on opposite sides of the ball with the shoe members having concave recesses on opposing surfaces for retaining the ball therebetween. Collar portions are integrally formed in opposed relation on the shoe members' radially inner ends, with each collar portion having a cylindrical surface positioned in conforming bearing contact with the guide rod permitting limited pivotal movement of the shoe members about the axis of the rod. The collars further provide additional bearing surfaces preventing the radially outer portions of the shoe members from being canted into non-parallel orientation and thereby minimize undesirable wear of the guide slot faces.

1 Claim, 4 Drawing Figures

GUIDE SHOE MEMBERS FOR WOBBLE PLATE COMPRESSOR

This invention relates to wobble plate refrigerant compressors and more particularly to an automotive air conditioning axial piston wobble plate compressor having improved guide shoe members for longitudinal accurate travel in a guide slot of the compressor housing.

In the co-pending U.S. Patent application Ser. No. 804,932, filed June 9, 1977, now U.S. Pat. No. 4,108,577, to Byron L. Brucken and Dennis A. Black, assigned to the same assignee as the present application, an automotive air conditioning wobble plate compressor is described. In compressors of this type a guide rod, with a ball on its free end, extends radially from the wobble plate with the ball and rod undergoing combined longitudinal and arcuate travel in a guide slot of the compressor housing imparted by the wobble plate movement. Upon rotation of the compressor drive shaft shoe discs within the guide slot are positioned on opposite sides of the ball allowing the wobble plate to wobble without rotating, whereby the rotary movement of the shaft is converted into reciprocating movement of the pistons.

It is an object of the present invention to provide improved guide shoe members for use with the mentioned wobble plate compressor wherein the shoe members are formed with integral collar portions having cylindrical surfaces positioned in conforming bearing contact with the wobble plate guide rod such that each cylindrical surface extends through a predetermined arc less than a one-half circle to form a pair of shoulder portions, each shoulder portion of each pair of shoulder portions being located in opposed sufficiently spaced relation with the respective shoulder portion of the other pair so that a predetermined clearance is provided between the shoulder portions of each shoe member during longitudinal movement of the shoe members in the guide slot during any limited pivotal movement of the shoe members about the axis of the rod, thereby to compensate for the travel of the universal ball longitudinally, arcuately and laterally in the guide slot.

It is another object of the present invention to provide improved guide shoe members for an automotive air conditioning wobble plate compressor as set forth in the previous object wherein the guide shoe members' integral collar portions extend in a common plane normal to the axis of the wobble plate rod such that the collar portions form outer surfaces as inward extensions of their associated shoe member bearing surfaces, wherein the total outer surface of each shoe member is comprised of the collar portion outer surface and the shoe member outer surface, said total outer surface having a predetermined dimension along the rod greater than the predetermined depth of the associated slot bearing face, such that the travel of the ball to predetermined angular locations in the compressor housing guide slot moves a portion of the outer bearing surface of each shoe member into a non-bearing relation with the bearing faces of the slot, resulting in the outer surface of each collar portion then moving into bearing relation with its slow bearing face to compensate for such non-bearing relation by replacing that portion of each shoe member outer bearing surface that is in non-bearing relation with another portion of the shoe member outer bearing surfaces thereby to insure substantially constant bearing contact areas between each shoe member and its associated bearing faces of the guide slot.

Further objects and advantages of the present invention will be apparent from the following description, reference being had to the accompanying drawings wherein a preferred embodiment of the present invention is clearly shown.

Figure 1:
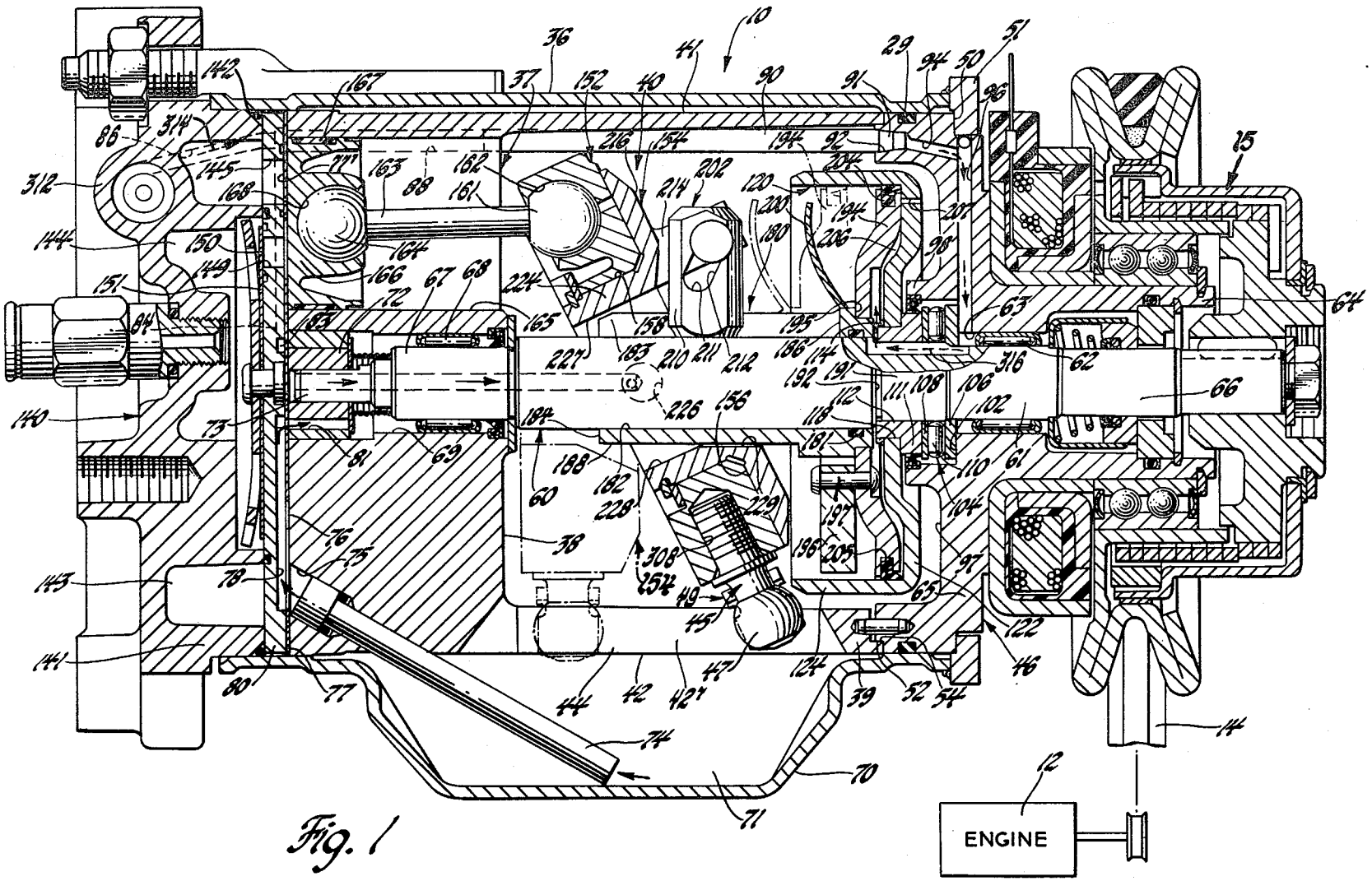
FIG. 1 is a vertical sectional view showing a wobble plate compressor including the improved guide shoe members of the present invention.

Referring now to the drawings, wherein a preferred embodiment of the present invention is shown, numeral 10 in FIG. 1 designates a variable displacement axial compressor which is adapted to be driven by a main car engine 12 through belt 14 and a suitable clutch such as an electromagnetic clutch 15 more fully described in the issued U.S. Pat. No. 4,061,443 to Black et al. and U.S. Pat. No. 3,876,048 to Brier.

Figure 3:
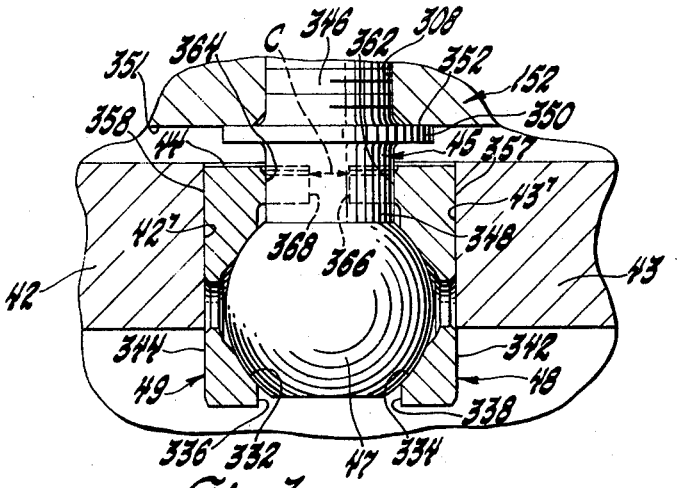
FIG. 3 is a fragmentary sectional view taken substantially on the line 3—3 of FIG. 2.

The compressor 10 includes an outer housing shell 36, which is substantially cylindrical in shape, formed from sheet metal or as a casting. The shell 36 encircles an inner cylinder case, generally indicated at 37, preferably cast in one piece from aluminum. The case 37 comprises a rear cylinder block 38 and a front cylinder collar 39 with a wobble plate mechanism 40 positioned therebetween. The cylinder case, block and collar are interconnected by a pair of longitudinally extending stringers one of which is indicated at 41 and a pair of guide stringers 42 and 43 (FIGS. 1 and 3). A longitudinal guide slot 44 is formed between the guide stringer for the reception of a ball stud 45 supporting a universal ball 47 by means of a pair of guide shoe members 48, 49 which are the subject of this application and will be described in detail below.

A front head 46, preferably formed as an aluminum casting, is partially telescoped in the right or front end of the housing shell 36 and is suitably sealed thereto as by O-ring seal 29. An outer peripheral notch 50 is formed in the front head 46 for flush engagement of a ring 51, which ring is suitably secured as by welding to circumscribe the front end of the housing shell 36. The front head 46 has an inner annular recess 52 which telescopically interfits a complementary recess 54 of the collar 39 in nested fashion so as to align the bearing bores for reception of the compressor main drive shaft 60.

The compressor main drive shaft 60 has its forward bearing portion 61 rotatably mounted or journaled on front needle bearing 62 in axial bore 63 formed in a protruding integral tubular extension 64 loacted on the outer surface of the front head end cover portion 65. The extension 64 is coaxial with and surrounds the shaft intermediate end 66 in concentric fashion. The shaft 60 has its rearward reduced end 67, journaled on rearward needle bearing 68 in rear axial bore 69 of the cylinder block 37.

The housing shell 36 completely encloses the compressor wobble plate mechanism 40 and is provided with a distended bulge portion 70 forming an oil sump or crankcase region 71 which collects, by gravity flow, oil and refrigerant mixture therein received from piston blowby for circulation through the compressor by suitable oil flow passages providing a lubricating network for its associated bearings and seals. Lubricating oil gear pump means in the form of an oil pump assembly 72, driven by a D-shaped quill 73 providing a reduced end extension of the shaft rearward end 67, serves to withdraw oil and refrigerant solution from the sump 71 through an oil pickup tube or conduit 74. The tube 74 with its open upper end inserted in angled counterbore 75 of the cylinder block 38, communicates via aperture 76 in reed valve disc 77 with an aligned vertical slotted passage 78, formed in the inner surface of the valve plate 80. The passage 78 has its upper end positioned in communication with the inlet side 81 of the gear pump 72.

The gear pump outlet communicates with an inner portion of an upper oil outlet groove, shown by dashed line 84, with the groove 84 terminating adjacent the periphery of the valve plate 80 in a valve plate hole or orifice which communicates with a rear head oil outlet bore 86. The valve plate 80 includes aperture means which communicate with the inlet of crossover passage means including axial cylinder block duct 88 shown by dashed lines in FIG. 1. The forward or outlet end of the duct 88 is connected to the rearward end of an axially aligned crossover tube 90, located outboard of the wobble plate mechanism 40. The tube 90 portion of the crossover passage means has its forward or outlet end reduced at 91, as by swaging, to provide a sealed press fit within a conical aperture 92 in the front head 46.

The front head 46 provides duct means communicating with the crossover tube outlet 91 in the form of an obliquely downwardly sloped duct portion 94 communicating with the outer end of radial duct portion 96, the inner end of which is open to the front head axial bore 63. The front head 46 inner face 97 includes a sleeve-like concentric extension 98 which, with tubular extension 64, is cast in one piece with the front head. The sleeve-like extension 98 encloses a counterbored shoulder portion 102 defining a thrust bearing surface on which is seated front thrust needle bearing assembly 104, including outer and inner thrust rings 106 and 108 respectively, having needle bearings 110 therebetween. The outer ring 108 is in flush engagement with flange 111 of cylinder bushing 112 fixedly centered as by weld 114 and axial bore 118 of a cup-shaped cylinder, generally designated 120. The cup-shaped cylinder 120 is oriented with its base 122 in opposed relation to the inner face 97 of the front head cover portion 65. The cylinder 120 has its cylindrical wall portion 124 extending rearwardly from its base 122 such that the open end of the cup-shaped cylinder faces the wobble plate mechanism 40.

The valve plate 80 is held against the end of the cylinder block 38 by means of a cylinder rear head assembly 140 having a cylindrical portion 141 which telescopes within the aft end of the shell 36 and is sealed thereto by compressible sealing means such as O-ring 142 sealed to the shell. The rear cylinder head assembly includes an outer suction or inlet chamber 143 and a center discharge chamber 144. Each compression chamber or bore 165 communicates with the suction chamber 143 through an inlet port such as port 145. The inlet reed valve disc 77, having inlet reeds 77′ controls the flow of refrigerant through the suction inlet ports 145. The compressed refrigerant leaves each compression bore 165 through valve plate discharge port 149, while a reed valve 150, in discharge reed valve disc 151, located in each discharge port 149 is provided as shown in detail in the above-referenced Black et al patent.

For purposes of illustrating this invention, the variable displacement five cylinder axial compressor 10 will be described whereas it will be understood that the number of cylinders may be varied without departing from the scope of the present invention. As seen in FIG. 1, the wobble plate drive mechanism 40 includes a socket plate 152 and a journal plate 154. The journal plate 154 and socket plate 152 define a plane bearing surface 156 and an outer cylindrical journal surface 158 with the journal plate being pivotally connected to sleeve member 180, rotates in unison with the shaft 60. The socket plate 152 has five sockets, one of the sockets being shown at 162, for receiving the spherical ends 161 of five connecting rods, such as the connecting rod 163. The free end of each of the connecting rods are provided with spherical portions 164 as shown.

Cylinder block 38 has five axial cylinder bores 165 in which pistons 166 are sealed by suitable rings 167 which rings in the disclosed form are Teflon washers. Pistons 166, having socket-like formations 168, engage one end of each connecting rod 163. Thus, the pistons 166 operate within their associated compression bores 165 whereby upon rotation of the drive shaft 60 the wobble plate mechanism 40 will produce reciprocation of the pistons 166 within their bores 165. The socket plate 152 is prevented from rotating by means of the guide rod having its ball 47 slidably retained by applicants' new guide shoe members 48 and 49 which slide within the longitudinal slot 44 formed between the guide stringers 42 and 43. As seen in FIGS. 1 and 3, the one-piece ball stud or guide rod 45 is provided on one end thereof with the generally spherical ball 47, a reduced diameter neck or rod portion 348 joined to the ball 47, a head portion 350 joined to the rod portion 348 and a threaded shank 346 which extends axially from the head portion 350. The ball stud 45 is an integral construction preferably formed of steel with the ball 47 being hardened. The threaded shank 346 is received in a threaded inner bore 308 of wobble plate mechanism socket plate 152 in a secure manner by a suitable tool, such as an Allen head wrench, received in hexagonal axial bore 310.

To continue with the description of the compressor, a generally cylindrical sleeve member 180 surrounds the shaft 60 in hydraulic sealing relation therewith by virtue of a compressible sealing means such as O-ring seal 181 located in a groove in the inner surface 182 of the sleeve. The sleeve member 180 has formed therein a longitudinal slot 183 extending from the sleeve inner or rearward face 184 substantially the full length of the sleeve and terminates in a U-shaped radius portion 186 within the confines of the cup-shaped cylinder 120. As seen in FIG. 1, sleeve reciprocating or modulating means are provided by hydraulic expansible chamber 206 defined in part by the cup-shaped rearwardly opening modulating cylinder 120, which is secured by means of bushing 112 located on the shaft portion 191 and abuts against shaft shoulder 192 for rotation therewith. The actuator means includes an axially movable internal disc-shaped modulating piston member 194 having a counterbalance 196 suitably secured thereto as by a rivet 197. In the disclosed embodiment the modulating piston 194 abuts sleeve shoulder 195 and is suitably fixed on the sleeve 180 for rotation therewith. A return spring 200 is retained on the sleeve and is operative upon the modulating piston 194 and sleeve 180 being moved axially rearwardly or to the left from its full line position to a dashed line position for contacting drive lug 202 upon the wobble plate mechanism 40 being pivoted to its vertical, dashed line, zero stroke position normal to the shaft 60. Suitable hydraulic seal means are provided between the disc-shaped piston 194 and the inner annular surface of the cylinder 120 which seal means in the disclosed form is a resilient seal ring 204 located in peripheral groove 205 formed in the edge of the disc-shaped piston 194.

The modulating piston member 194 cooperates with the cylinder 120 to form an expansible chamber 206 the size of which is varied by an hydraulic control system supplying lubricant or hydraulic fluid under pressure into the chamber 206. The control system may include a control valve, located in the rear head housing 312, to control the flow of oil from the pump 72 to the expansible chamber 206 as shown by the dashed arrows 314 and 316. Thus, at high lubricant pressures, the disc-shaped piston 194 and sleeve 180 will be shifted or moved axially to the left as shown by the dashed lines in FIG.1.

To complete the description of the compressor the lug 202 includes a driving connection portion 210 having formed therein a guide slot or cam track 212 which extends radially along the axis of the drive shaft 60 such that the track 212 is at least partially offset from the axis of the lug. The journal element 154 carries an earlike member 214 projecting normal to the journal face 216 and has a through bore (not shown) for receiving cam follower means in the form of a cross pin driving member or follower 220. Upon the pin 220 contacting the bottom radius 211 of the cam track 212 the journal element 154 is disposed in a plane perpendicular to the axis of rotation of the shaft 60 rendering the compressor ineffective to compress refrigerant gas. FIG. 1 shows the location of the wobble plate mechanism 40 for maximum compressor capacity wherein the follower pin 220 is positioned at the radially outer end of cam track 212 defining the maximum stroke lengths for each of the pistons 166.

As shown in FIG. 1 and described more fully in the above-mentioned Brucken, et al patent application Ser. No. 804,932, journal plate hub 224 receives the sleeve 180 in the hub's generally rectangular sectioned axial opening defined in part by upper and lower faces 227 and 228. The chamfered surface 229 provides a clearance with the sleeve surface 188 in the full stroke position. Upon assembly the journal hub cross bores 226 are aligned with the sleeve bores for the reception of a transverse pivot trunnion pin (not shown) permitting the wobble plate assembly 40 to pivot thereabout.

At high lubricant pressures developed from pump fluid outlet 83, the disc-shaped piston 194 and sleeve 180 will be shifted axially to the left. The expansible chamber 206 is unloaded upon a decrease in pressure therein resulting in the piston 194 being moved to the right upon the removal of hydraulic fluid from chamber 206 by suitable passage means such as a bleed hole, shown at 207 in modulating cylinder base wall 122.

Figure 2:
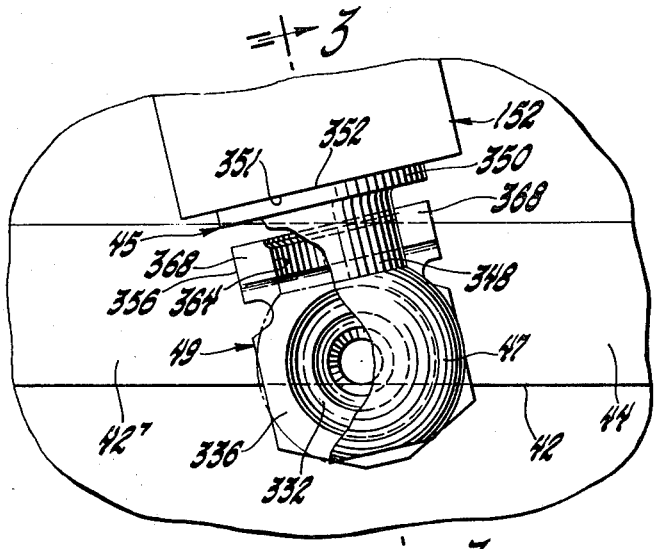
FIG. 2 is an enlarged fragmentary vertical sectional view of the wobble plate guide rod, ball and housing guide slot portion of the compressor with the wobble plate positioned at an angle of approximately 13° from the vertical.
Figure 4:
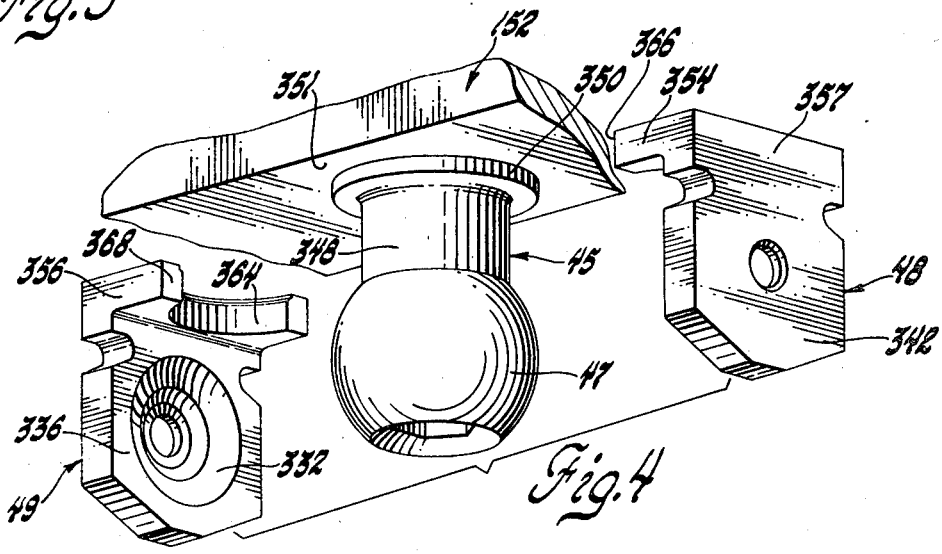
FIG. 4 is an exploded perspective view of the rod ball extension of the wobble plate with the improved shoe discs.

Turning now to a description of the guide shoe members, which are the subject of the present application, it will be seen in FIGS. 2–4 that the pair of guide shoe members 48 and 49 which are essentially of identical construction, are positioned in the guide slot 44 on opposite sides of the ball 47. As best seen in FIG. 4, each shoe member has a concave recess 332 and 334 on their opposing surfaces 336 and 338 respectively, with the recesses facing each other for receiving and retaining or capturing the ball 47 therebetween. The shoe members 48 and 49 each have an outer bearing surface 342 and 344 in bearing contact with its associated slot bearing faces 43' and 42', respectively.

As stated above, the ball stud 45 includes the upper threaded shank portion 346 connected to the ball 47 by means of the rod portion 348. Rod portion 348 is formed with a finished or smooth cylindrical bearing surface and is separated from its threaded shank portion 346 by means of the integral washer-like head portion 350 such that the undersurface 352 of the head portion 350 contacts the outer planar surface portion 351 of the socket plate 152 to accurately position the ball 47 relative to the guide slot 44.

The shoe members 48 and 49 each have a collar portion 354 and 356 respectively, each integrally formed in opposed relation on the radially inner end of its associated shoe members such that upon the shoe members being positioned as shown in FIG. 3, the collar portions 354 and 356 extend in a common plane normal to the axis of the rod portion 348.

As seen in FIGS. 3 and 4, each of the collar portions 354, 356 includes an outer surface 357 and 358 respectively formed as an inward extension of its associated shoe member outer bearing surfaces 342 and 344. It will be appreciated that the total outer surface of each shoe member is comprised of its collar portion outer surface 357, 358 and its associated show member outer surface 342, 344 with the total outer surface of each shoe having a predetermined dimension along the rod portions 348 principal axis greater than the predetermined depth of their associated stringer bearing faces 42', 43'.

With reference to FIGS. 2–4, the collar portions have opposed inner surfaces 362 and 364 each formed as a cylindrical surface portion positioned in conforming bearing contact with the rod portion 348. In this manner each cylindrical surface portion 362, 364 which extend through a predetermined arc less than a one-half circle to form a pair of shoulder portions indicated at 366 and 368 for collar portions 354 and 356 respectively. As viewed in FIG. 3, it will be seen that each pair of shoulder portions, such as portions 366, are located in opposed substantially spaced relation with the respective shoulder portion 368 of the other pair of shoulder portions so that a predetermined clearance, indicated by dimension C, is provided between the shoulder portions of each shoe member during longitudinal movement of the shoe members 48, 49 in the guide slot 44 and during any limited pivotal movement of the shoe members about the axis of the rod portion. The provision of such a clearance C allows the shoe members 48, 49 to compensate for the travel of the ball 47 longitudinally, arcuately and laterally in the guide slot. Consequently, travel of the ball 47 to predetermined angular locations in the slot 44 moves a portion of the outer bearing surface 342, 344 of each shoe member 48, 49 respectively, into a non-bearing relation with the bearing faces 43', 42' of the slot 44. The extreme non-bearing position of the surfaces 342, 344 is indicated clearly in FIG. 3.

It will be appreciated that during the above-described non-bearing condition the outer surfaces 357 and 358 of each collar portion of the shoe members is operative to move into bearing relation with its associated slot bearing face. In this manner applicants' improved shoes compensate for such non-bearing relation by replacing the portion of the shoe member outer bearing surface that is in non-bearing relation with another portion of the shoe member outer bearing surfaces. Thus, applicants have provided an improved shoe design which insures substantially constant bearing contact areas between each shoe member and its associated bearing face of the guide slot.

It will further be noted that cooperation between the rod portion 348 and the shoe cylindrical surface portions 362, 364 prevent the outer surface 342, 344 of either shoe member from being canted into a non-parallel orientation with respect to each other bearing face 43', 42' respectively. The result is that applicants' improved shoe members minimize undesirable wear of the bearing faces caused by the gouging of the faces by edge portions of the shoe members if they were allowed to be canted into the aforementioned non-parallel orientation.

While the embodiment of the present invention as herein disclosed constitutes a preferred form, it is to be understood that other forms might be adopted.

The embodiments of the invention in which an exclusive property or privilege is claimed are defined as follows:

1. In a compressor having a housing, a cylinder block disposed in one end of said housing forming longitudinally aligned cylinder bores receiving pistons therein, a working chamber defined between said block and one wall of said housing, a drive shaft rotatably supported in said working chamber, an annular wobble plate operated in response to rotation of said drive shaft and drivingly connected to said pistons at locations therearound spaced radially from said drive shaft to reciprocate said pistons, means for translating the movement of said wobble plate into reciprocation of the pistons, said housing having a longitudinally extending guide slot formed therein in a common plane with said drive shaft and defining opposed substantially parallel plane bearing faces of predetermined depth, at least one of the driving connections of said wobble plate to its respective piston being spaced transversely from said common plane and said bearing faces whereby during movement of said wobble plate a driving force occurs at said one driving connection which is offset from said common plane, said wobble plate supporting a radially extending cylindrical rod portion formed with a ball on its outer end, said ball positioned for longitudinal and arcuate travel in said slot as a result of said wobble plate movement and tending toward travel lateral to said slot as a result of said offset force, and a pair of spaced guide shoe members positioned in said slot on opposite sides of said ball, said shoe members having concave recesses on opposing surfaces thereof facing each other for receiving and retaining said ball therebetween, said shoe members each having an outer bearing surface in bearing contact with its associated slot bearing face, the improvement wherein said shoe members have collar portions integrally formed in opposed relation on their radially inner ends and extending in a common plane normal to the axis of said rod portion, said collar portions forming outer surfaces as inward extensions of their associated shoe member outer bearing surfaces, wherein the total outer surface of each said shoe member is comprised of the collar portion outer surface and the shoe member outer surface, said total outer surface having a predetermined dimension along said rod portion greater than the predetermined depth of the associated slot bearing face, said collar portions having opposed inner surfaces each formed as a cylindrical surface portion positioned in conforming bearing contact with said rod portion, each said cylindrical surface portion extending through a predetermined arc less than a one-half circle to form a pair of shoulder portions, each shoulder portion of each pair of shoulder portions being located in opposed sufficiently spaced relation with the respective shoulder portion of the other pair so that a predetermined clearance is provided between the shoulder portions of each shoe member during longitudinal movement of the shoe members in said slot and during any limited pivotal movement of the shoe members about the axis of said rod portion, thereby to compensate for the travel of said ball longitudinally, arcuately and laterally in said slot, and whereby the travel of said ball to predetermined angular locations in said slot moves a portion of the outer bearing surface of each shoe member into a non-bearing relation with the bearing faces of said slot, said outer surface of each collar portion of said shoe member then moving into bearing relation with its slot bearing face to compensate for such non-bearing relation by replacing that portion of each shoe member outer bearing surface that is in non-bearing relation with another portion of said shoe member outer bearing surfaces thereby to insure substantially constant bearing contact areas between each said show member and its associated bearing face of the guide slot, and whereby cooperation between said rod portion and said cylindrical surface portions prevent the outer surface of either shoe member from being canted into a non-parallel orientation with respect to each other bearing face to thereby minimize undesirable wear of the bearing faces by reason of gouging thereof by said shoe members.

* * * * *

UNITED STATES PATENT AND TRADEMARK OFFICE

CERTIFICATE OF CORRECTION

PATENT NO. : 4,178,136

DATED : December 11, 1979

INVENTOR(S) : Earl Reid & Carl A. Copp, Jr.

It is certified that error appears in the above-identified patent and that said Letters Patent are hereby corrected as shown below:

Column 2, line 62, "loacted" should read -- located --.

Column 6, line 31, "show" should read -- shoe --.

Column 7, line 1, "the" should read -- that --.

Column 8, line 44, "show" should read -- shoe --.

Signed and Sealed this

*Twentieth* Day of *May 1980*

[SEAL]

*Attest:*

SIDNEY A. DIAMOND

*Attesting Officer*

*Commissioner of Patents and Trademarks*